US007631627B2

(12) United States Patent
Sarbacker et al.

(10) Patent No.: US 7,631,627 B2
(45) Date of Patent: Dec. 15, 2009

(54) VOLTAGE SAG PREVENTION APPARATUS AND METHOD

(75) Inventors: Shawn D. Sarbacker, North Wales, PA (US); Poh Fong Chin, Novi, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/928,175

(22) Filed: Oct. 30, 2007

(65) Prior Publication Data

US 2009/0107443 A1 Apr. 30, 2009

(51) Int. Cl.
*F02N 17/00* (2006.01)

(52) U.S. Cl. ..... 123/179.4; 123/179.1

(58) Field of Classification Search ... 123/179.1–179.4; 180/65.5; 307/64, 66, 87, 10.1, 10.7; 257/138, 257/148, 154, 162; 327/427, 564; 320/104, 320/150; 903/903, 926, 927, 943; *F02N 17/00*
See application file for complete search history.

(56) References Cited

U.S. PATENT DOCUMENTS 4,502,070 A * 2/1985 Leipold et al. ..... 257/138
6,218,744 B1 * 4/2001 Zahrte et al. ..... 307/64
6,630,810 B2 * 10/2003 Takemasa et al. ..... 320/104
6,717,288 B2 * 4/2004 Besnier et al. ..... 307/10.1
6,943,460 B2 * 9/2005 Wakashiro et al. ..... 290/40 C
7,148,653 B2 * 12/2006 Mauro et al. ..... 320/104
7,489,048 B2 * 2/2009 King et al. ..... 307/10.1
2003/0230443 A1 * 12/2003 Cramer et al. ..... 180/65.5
2004/0084965 A1 * 5/2004 Welches et al. ..... 307/64

* cited by examiner

*Primary Examiner*—Stephen K Cronin
*Assistant Examiner*—Keith Coleman
(74) *Attorney, Agent, or Firm*—Quinn Law Group, PLLC

(57) ABSTRACT

A vehicle includes an engine, a controller for turning off the engine when the vehicle is idle, a motor/generator for starting the engine, an inverter for converting a DC auxiliary voltage from a battery into an AC voltage for powering the motor/generator, and a device for isolating a DC voltage from the DC auxiliary voltage to prevent voltage sag in a vehicle system during engine starting. The device includes a transformer, a rectifier/regulator, and an isolator. A mechanical relay opens, or an FET is activated, to isolate the DC voltage during engine start. A method for preventing voltage sag in an auxiliary vehicle system includes detecting a commanded engine start, comparing a measured auxiliary voltage to a threshold, isolating a predetermined DC voltage from a DC auxiliary voltage when the measured auxiliary voltage is less than the threshold, and powering the auxiliary vehicle system using the isolated DC voltage.

12 Claims, 3 Drawing Sheets

ACTIVE ISOLATION : MECHANICAL

ACTIVE ISOLATION : SOLID STATE

VOLTAGE SAG PREVENTION APPARATUS AND METHOD

TECHNICAL FIELD

The present invention relates to an apparatus and method for preventing voltage sag during an engine cranking event in a vehicle utilizing a mild hybrid system.

BACKGROUND OF THE INVENTION

In a typical mild hybrid vehicle, an internal combustion engine provides the power necessary for propelling the vehicle, with the engine being configured to shut off when the vehicle is idle or at a standstill. In this manner, fuel may be conserved, particularly during stop-and-go traffic conditions. When a driver depresses an accelerator pedal to launch a mild hybrid vehicle, an electric drive motor connected to a 12-volt auxiliary battery provides an initial burst of power lasting through a duration of time required for cranking and starting the engine, which is approximately 400 to 500 milliseconds (ms). The drive motor used in such a mild hybrid design is not used to power the vehicle independently of the engine, as would a conventional or "full" hybrid vehicle. However, mild hybrid vehicles remain desirable for some purposes, as such vehicles may be configured to provide, for example, regenerative braking and/or idle stop capabilities while reducing required engine size.

The 12-volt auxiliary battery provides the necessary direct-current (DC) voltage and associated DC current needed for cranking the engine, and also provides a sufficient auxiliary DC voltage for use by various vehicle systems, for example headlights, interior lights, and wiper blade systems. However, because of the relatively high electrical load placed on the battery during cranking of the engine, a temporary or transient reduction in the amount of voltage supplied to the auxiliary system may occur. This reduction in voltage, referred to as "voltage sag" hereinafter, typically lasts through the same 400 to 500 ms duration of time required for cranking and starting of the engine discussed above. If this voltage sag exceeds a threshold level, the result may become perceptible to an operator or passenger of the vehicle. For example, the headlights or interior lights may dim momentarily, and/or windshield wiper speed may temporarily decrease or pause. While a dedicated secondary battery may provide a sufficient amount of cranking assist voltage to allow the auxiliary battery to supply a substantially constant voltage to the auxiliary systems, a duplicate battery may be less than optimal due to its added size, weight, and cost.

SUMMARY OF THE INVENTION

Accordingly, a vehicle is provided having an engine, a controller, an energy storage device (ESD), a voltage inverter, and a voltage sag prevention device for preventing voltage sag in an on-board auxiliary vehicle system. The controller turns the engine off when the vehicle is at a standstill, while the motor/generator cranks and starts the engine when the vehicle is launching. The ESD provides a direct-current (DC) auxiliary voltage, while the voltage inverter converts the DC auxiliary voltage into an alternating-current (AC) voltage sufficient for powering the motor/generator during cranking and starting of the engine.

In one aspect of the invention, the voltage sag prevention device is electrically connected to the ESD and to the voltage inverter, and is operable for isolating a DC cranking support voltage from the DC auxiliary voltage during cranking and starting of the engine.

In another aspect of the invention, the voltage sag prevention device includes a voltage transformer, a voltage rectifier/regulator, and a voltage isolation device.

In another aspect of the invention, the voltage isolation device includes a mechanical relay which opens during the cranking and starting of the engine.

In another aspect of the invention, the voltage isolation device includes a first and a second field effect transistor (FET). The first FET is inactive and the second FET is active during cranking and starting of the engine.

In another aspect of the invention, the auxiliary vehicle system is a 12-volt auxiliary system selected from the group of headlights, windshield wipers, interior lights, and radio.

In another aspect of the invention, an apparatus is provided for preventing voltage sag in an auxiliary vehicle system aboard a mild hybrid vehicle. The apparatus includes a DC-to-AC voltage inverter for providing an alternating current (AC) voltage sufficient for powering the electric motor/generator, as well as a voltage sag prevention device for producing a DC cranking support voltage from the AC voltage, and for isolating the DC cranking support voltage from a DC auxiliary voltage during cranking and starting of the engine. The isolated DC cranking support voltage powers the auxiliary vehicle system during a transient duration of time required for completing the cranking and starting of the engine.

In another aspect of the invention, a method is provided for preventing voltage sag in an auxiliary vehicle system of a vehicle having a battery with an auxiliary voltage, an engine configured to shut off when the vehicle is idle, and an electric motor operable for cranking and starting the engine. The method includes detecting a commanded cranking and starting of the engine, measuring the auxiliary voltage when cranking and starting of the engine is detected, and comparing the measured auxiliary voltage to a stored threshold voltage. The method further includes isolating a predetermined amount of DC cranking support voltage from the auxiliary voltage when the measured auxiliary voltage is less than the stored threshold voltage, and powering the auxiliary vehicle system using the isolated predetermined amount of DC cranking support voltage.

In another aspect of the invention, the method includes detecting a completion of the cranking and starting of the engine, and then powering the auxiliary vehicle system using the auxiliary voltage when completion of the cranking and starting of the engine is detected.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
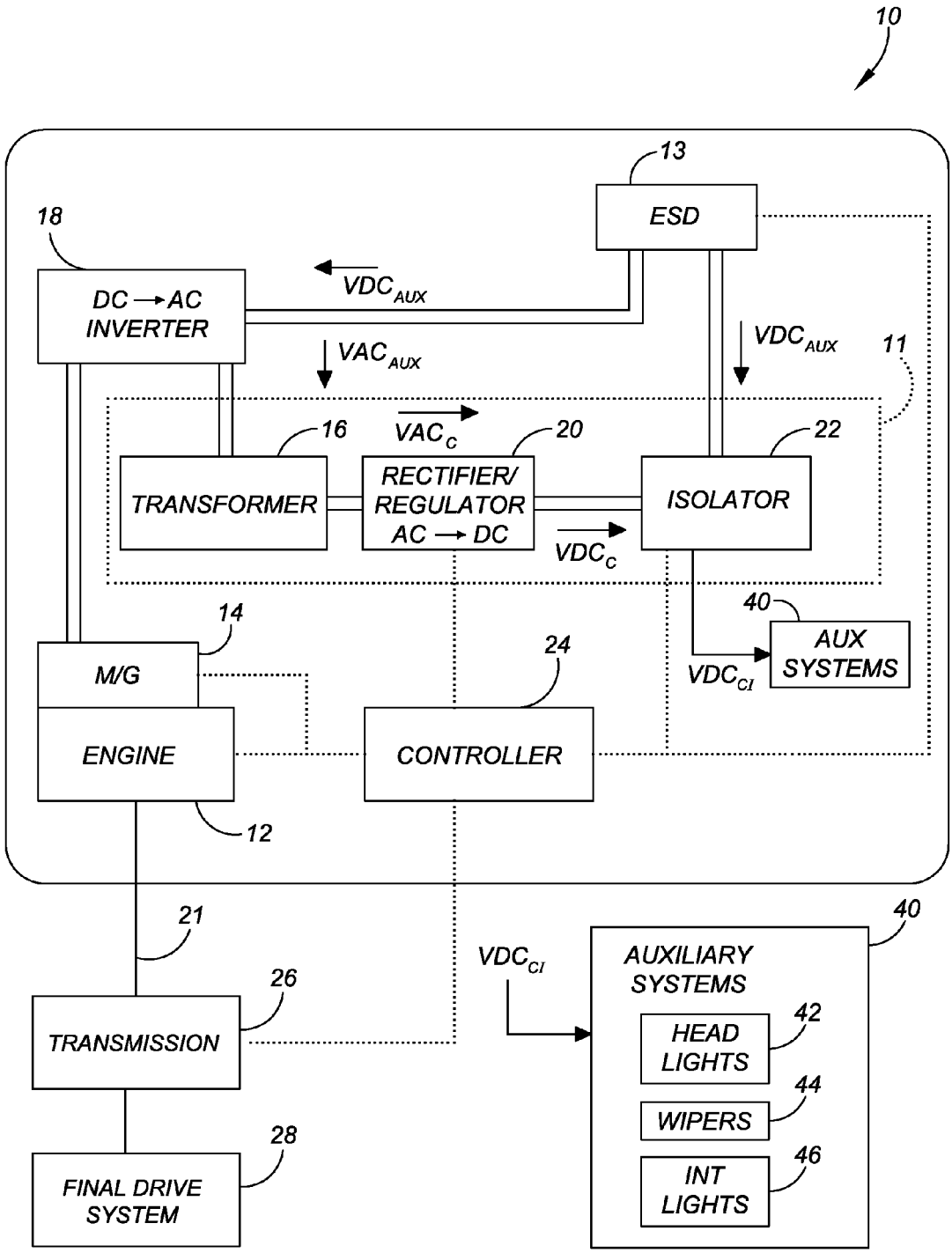
FIG. 1 is a schematic illustration of a mild hybrid vehicle having a voltage sag prevention apparatus according to the invention.

Referring to the drawings, wherein like reference numbers refer to like components, and beginning with FIG. 1, a schematic illustration of a mild hybrid vehicle 10 is shown. The vehicle 10 has an engine 12 operatively connected to motor/generator 14, which is abbreviated hereinafter as M/G 14 for simplicity. M/G 14 is configured for cranking and starting of the engine 12 during a launch of vehicle 10 from a standstill or idle condition. Engine 12 is drivingly connected with an input member 21 of a transmission 26, and also with a final drive system 28, for propulsion of vehicle 10.

M/G 14 is electrically connected to an energy storage device (ESD) 13, such as a rechargeable single battery or a battery pack. ESD 13 is adapted to store an amount of energy from M/G 14 when the M/G 14 is operating as a generator, from engine 12 when the engine 12 is producing excess energy, and/or from regenerative braking when vehicle braking power is being recuperated. Likewise, M/G 14 is further adapted for receiving energy from the ESD 13 as necessary when the M/G 14 is acting as an electric motor, and in particular when the M/G 14 is used for cranking and starting of the engine 12.

Figure 3:
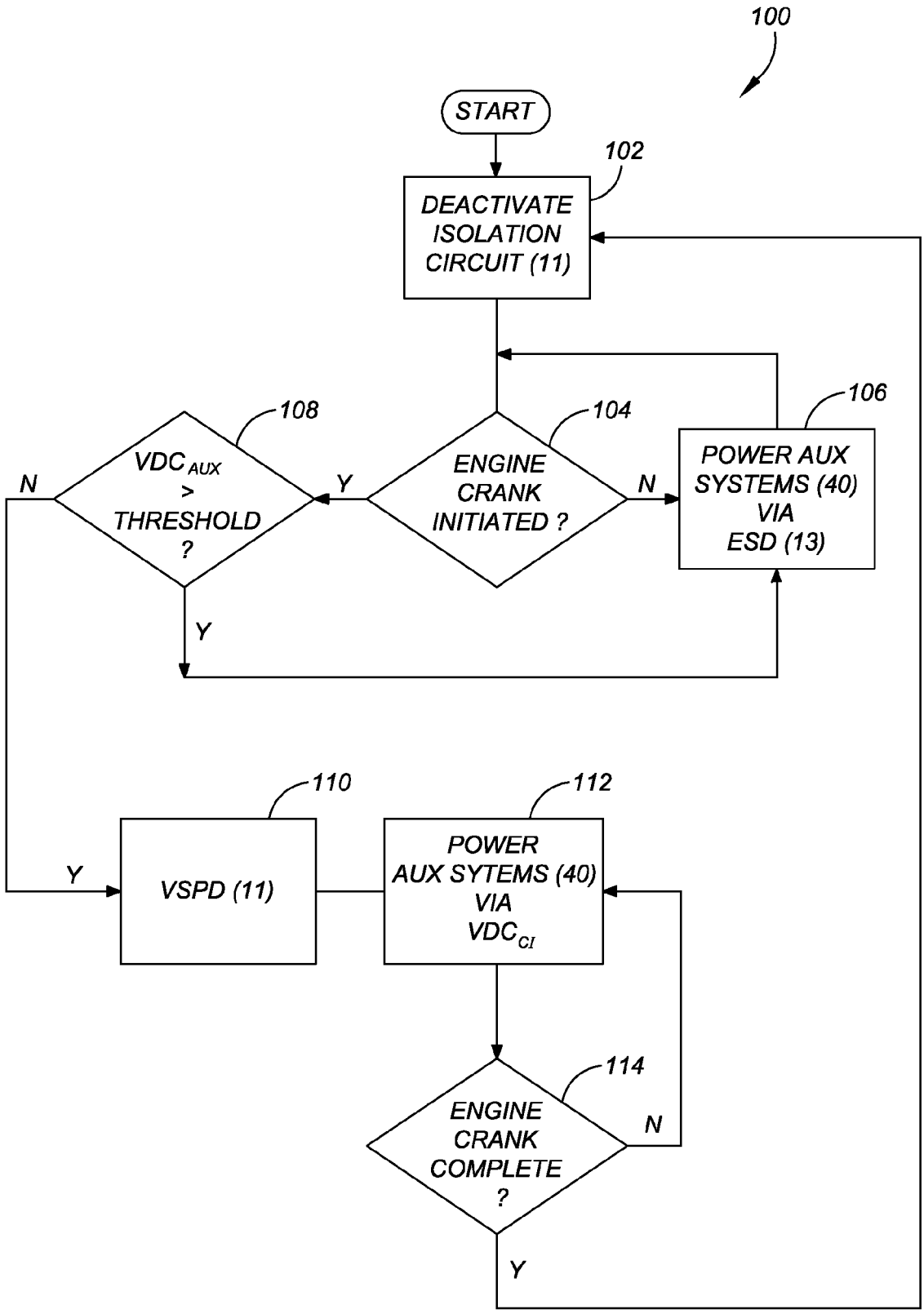
FIG. 3 is a flowchart describing a method or algorithm for preventing voltage sag in a mild hybrid vehicle.

An electronic control unit or controller 24 is in communication with M/G 14, engine 12, and ESD 13, and with one or more of the various components of a voltage sag prevention device 11, or VSPD 11, as will be described later hereinbelow. Controller 24 may be programmed and/or configured to include a hybrid control module, an engine control module, a transmission control module, a motor/generator control module, and/or any necessary electronic drives or power electronics circuits, as well as a voltage isolation circuit control method or algorithm 100, as described below and as shown in FIG. 3.

ESD 13 is ordinarily configured as a 12-volt direct current (DC) energy storage device such as a DC battery, although other voltage levels and energy storage devices may be useable within the scope of the invention. M/G 14 is preferably a three-phase alternating current (AC) device. ESD 13 is therefore connected to M/G 14 through an inverter 18. The inverter 18 adapted for converting a direct current (DC) auxiliary voltage provided by the ESD 13, abbreviated as $VDC_{AUX}$ hereinafter, into a three-phase alternating current (AC) output usable by M/G 14, and abbreviated as $VAC_{AUX}$ hereinafter. During cranking and starting of the engine 12, therefore, the DC auxiliary voltage ($VDC_{AUX}$) from ESD 13 is pulled or drawn through the inverter 18 and converted therein into a suitable AC auxiliary voltage ($VAC_{AUX}$) having a predetermined phase and amplitude suitable for powering M/G 14.

The initiation of a cranking and starting event of the engine 12, such as would occur when an operator of vehicle 10 depresses an accelerator pedal or other accelerator device (not shown) while the vehicle 10 is idle and the engine 12 is turned off to conserve fuel, acts a predetermined signal or input condition to controller 24 alerting the controller 24 to activate a voltage sag prevention device (VSPD) 11 of the invention. VSPD 11 includes a voltage transformer 16, a voltage rectifier/regulator 20, and a voltage isolator 22, and is configured for selectively isolating a potentially sagging DC cranking support voltage, abbreviated $VDC_C$, from the DC auxiliary voltage ($VDC_{AUX}$) supplied by ESD 13, as will now be explained in further detail.

Still referring to FIG. 1, transformer 16 is an AC-to-AC voltage transformer of the type known in the art, and is configured to receive as an input the AC auxiliary voltage ($VAC_{AUX}$) from the inverter 18, as described above. The transformer 16 then transforms the AC auxiliary voltage ($VAC_{AUX}$) into a suitable amplitude and frequency single-phase or multiple-phase AC cranking support voltage, as needed, with this transformed AC cranking support voltage abbreviated hereinafter as $VAC_C$. The AC cranking support voltage ($VAC_C$) is then fed into rectifier/regulator 20.

Within the rectifier/regulator 20, the transformed AC cranking support voltage ($VAC_C$) is converted into a suitable DC cranking support voltage, abbreviated $VDC_C$. Many conventional, low-cost rectification devices exist for providing this function, for example a standard bridge rectifier device. Rectifier/regulator 20 is further operable for comparing the DC cranking support voltage ($VDC_C$) to a calibrated value and adjusting the characteristics of the DC cranking support voltage ($VDV_C$) as necessary to effectively maintain the calibrated value. This calibrated value may be selected having amplitude sufficient for powering one or more required auxiliary systems 40 aboard the vehicle 10 during the approximately 400 to 500 millisecond duration required for M/G 14 to crank and start the engine 12, as described previously hereinabove.

The DC cranking support voltage ($VDC_C$) is then fed into the isolator 22, with the isolator 22 being configured to isolate the DC cranking support voltage ($VDC_C$) from the auxiliary voltage supply ($VDC_{AUX}$) provided by ESD 13 during a cranking and starting event, with the isolated DC cranking support voltage abbreviated in FIG. 1 and hereinafter as $VDC_{CI}$. By isolating the DC cranking support voltage ($VDC_C$) from the auxiliary voltage supply ($VDC_{AUX}$) during cranking and starting of the engine 12, one or more selected auxiliary systems 40 may thereby draw power from the isolated DC cranking support voltage ($VDC_{CI}$) rather than from the main $VDC_{AUX}$ output of ESD 13 in the usual manner. The DC auxiliary voltage ($VDC_{AUX}$) is then permitted to pass through the inverter 18 to power the cranking and starting of the engine 12, as well as to power any auxiliary systems onboard vehicle 10 that are not specifically included with the auxiliary systems 40, i.e. those selected auxiliary systems considered to be particularly sensitive to voltage sag.

Referring to the inset at the lower right portion of FIG. 1, a representative set of auxiliary systems 40 may include one or more vehicle systems or devices known to be particularly sensitive to a sudden drop or sag in voltage, such as headlights 42, wipers 44, and/or interior lights 46. Lighting devices such as headlights 42 and interior lights 46 may dim, or wipers 44 may pause or change speeds in a perceptible manner, in response to a transient drop in supply voltage. However, other auxiliary devices may not respond in a perceptible manner to such a voltage sag, and therefore may be omitted from the auxiliary systems 40 powered by the isolated DC cranking support voltage ($VDC_{CI}$). By so limiting the auxiliary systems 40 that are selectively powered by the isolated DC cranking support voltage ($VDC_{CI}$) to select group of voltage sag-sensitive devices, the overall power requirements of VSPD 11 may be minimized, and component size and/or cost may be optimized or reduced.

Figure 2A:
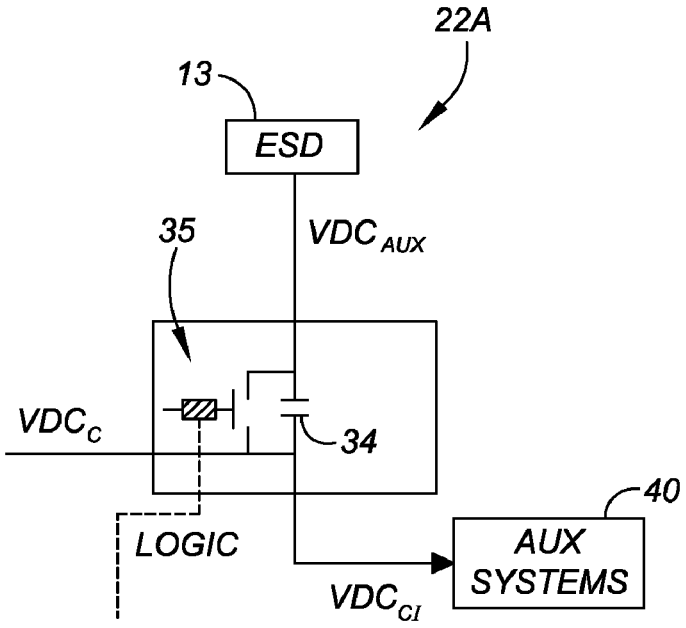
FIG. 2A is a schematic illustration of a mechanical voltage isolation device usable with the voltage sag prevention apparatus FIG. 2A.

Referring to FIG. 2A, one embodiment of isolator 22 of FIG. 1 is shown as an isolator 22A, with the isolator 22A providing active voltage isolation using a selectively controllable mechanical device, such as an electrically-actuated mechanical relay 35. The actuation of relay 35 is selectively controlled via control logic (LOGIC) programmed or stored in controller 24 (see FIG. 1). The relay 35 is normally closed, with the auxiliary systems 40 powered directly via the DC auxiliary voltage ($VDC_{AUX}$) from ESD 13. When the relay 35 is automatically opened in response to a commanded or initiated cranking and starting of the engine 12, the auxiliary systems 40 are directly powered using the isolated DC cranking support voltage ($VDC_{CI}$), with the open the relay 35 cutting off the DC auxiliary voltage ($VDC_{AUX}$) from the ESD 13.

To optimally isolate the DC cranking support voltage ($VDC_C$) from the DC auxiliary voltage ($VDC_{AUX}$) as isolated DC cranking support voltage ($VDC_{CI}$), the relay 35 may be positioned in parallel with a capacitor 34 providing sufficient timing buffering for instantaneous power availability to the auxiliary systems 40 when switching from ESD 13 to the isolated DC cranking support voltage ($VDC_{CI}$). The relay 35 then closes upon completion of the cranking and starting event so that auxiliary systems 40 are once again powered by the DC auxiliary voltage ($VDC_{AUX}$) provided by ESD 13.

Figure 2B:
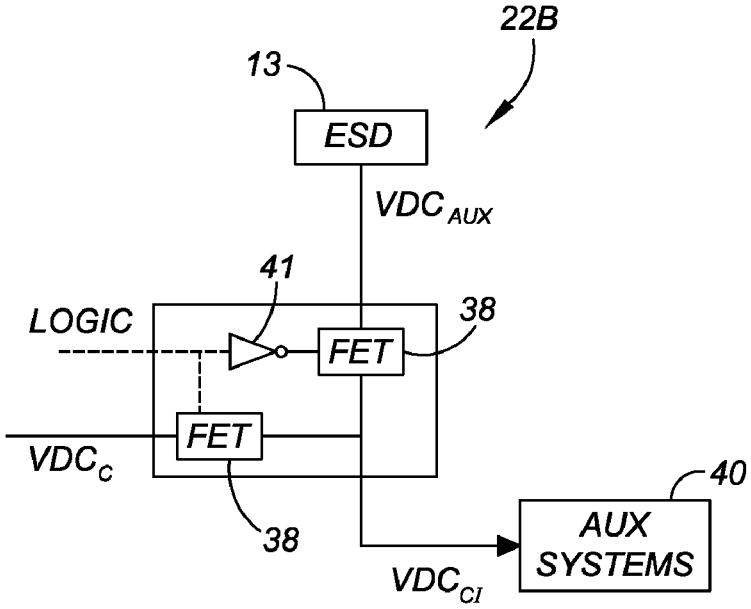
FIG. 2B is a schematic illustration of an alternate solid state voltage isolation device usable with the voltage sag prevention apparatus of FIG. 2A.

Referring to FIG. 2B, another embodiment of an isolator 22B is shown providing active isolation using a pair of selectively controllable field effect transistors or FET 38. Control logic (LOGIC) from the controller 24 (see FIG. 1) may include a 'not' logic gate 41 or logic inverter to ensure that only one of the FETS 38 is 'true' or active at a given instant. In this manner, the pair of FET 38 may be selectively controlled to power auxiliary systems 40 via the DC auxiliary voltage ($VDC_{AUX}$) when one FET 38 is active, and via the isolated DC cranking support voltage ($VDC_{CI}$) when the other FET 38 is active. While other voltage isolation devices may be usable within the scope of the invention in lieu of the embodiments of FIGS. 2A and 2B, such as passive isolation using one or more diodes, the more robust active isolation provided by the preferred embodiments of FIGS. 2A and 2B are preferred due to the enhanced controllability and more optimal energy, cost, and/or size advantages that such actively controlled devices may provide.

Referring to FIG. 3, a method or algorithm 100 is shown for minimizing voltage sag in a mild hybrid vehicle 10 (see FIG. 1), as described previously hereinabove. Algorithm 100 may be programmed, recorded, or otherwise stored in memory (not shown) of the controller 24, and is adapted for detecting or determining the presence of a predetermined operating condition indicating a commanded cranking and starting of the engine 12. In each of the following steps, the various components of vehicle 10 are shown in FIG. 1, except where otherwise noted.

Beginning with step 102, algorithm 100 deactivates voltage sag prevention device or VSPD 11 as a preliminary or zeroing step. Algorithm 100 then proceeds to step 104.

At step 104, the controller 24 detects or otherwise determines whether an engine cranking and starting event has been presently initiated or commanded. If engine cranking and starting has been initiated, algorithm 100 proceeds to step 108, otherwise algorithm 100 proceeds to step 106.

At step 106, the algorithm 100 powers auxiliary systems 40 via ESD 13, i.e. via the DC auxiliary voltage ($VDC_{AUX}$). Algorithm 100 then repeats step 104 in a continuous control loop until algorithm 100 detects or determines that cranking and starting of the engine 12 has been initiated or commanded, at which point algorithm 100 proceeds to step 108.

At step 108, algorithm 100 compares the DC auxiliary voltage ($VDC_{AUX}$) from the ESD 13 to a predetermined threshold voltage, abbreviated as 'threshold' in FIG. 3. This threshold voltage is a predetermined voltage below which perceptible voltage sag may be expected to occur in at least one of the selected auxiliary systems 40 (also see FIG. 1). If at step 108 it is determined that DC auxiliary voltage $VDC_{AUX}$ exceeds the stored threshold voltage, algorithm 100 repeats step 106. Otherwise, algorithm 100 proceeds to step 110.

At step 110, algorithm 100 activates VSPD 11 in response to the determination at step 108 that the DC auxiliary voltage ($VDC_{AUX}$) does not exceed the stored threshold voltage. Algorithm 100 then proceeds to step 112.

At step 112, algorithm 100 powers the selected auxiliary systems 40 (also see FIG. 1) using the isolated DC cranking support voltage ($VDC_{CI}$), thus allowing engine 12 to be cranked and started via the DC auxiliary voltage ($VDC_{AUX}$) provided by ESD 13. Algorithm 100 then proceeds to step 114.

At step 114, algorithm 100 detects or determines whether the cranking and starting of engine 12 detected at step 104 is complete, i.e. whether the engine 12 has been started and is running. If the engine 12 has been started, algorithm 100 returns to step 102 as described above. Algorithm 100 continues to power auxiliary systems 40 using the isolated DC voltage supply ($VDC_{CI}$) until such time as engine start is determined to be completed at step 114, before returning to step 102.

As described above with reference to FIGS. 2A and 2B, under algorithm 100, isolation of the DC cranking support voltage ($VDC_{CI}$) from the DC auxiliary voltage ($VDC_{AUX}$) includes opening a mechanical relay device 35 (see FIG. 2A) when the DC auxiliary voltage ($VDC_{AUX}$) is less than said stored threshold voltage, or alternately activating a field effect transistor (FET) 38 (see FIG. 2B) when the DC auxiliary voltage ($VDC_{AUX}$) is less than said stored threshold voltage.

While the best modes for carrying out the invention have been described in detail, those familiar with the art to which this invention relates will recognize various alternative designs and embodiments for practicing the invention within the scope of the appended claims.

The invention claimed is:

1. A vehicle comprising:

an engine;

at least one auxiliary vehicle system;

a controller adapted for selectively turning off said engine when the vehicle is at a standstill;

a motor/generator operable for cranking and starting said engine when the vehicle is launching from said standstill;

an energy storage device (ESD) having a direct-current (DC) auxiliary voltage;

a voltage inverter for converting said DC auxiliary voltage into an alternating-current (AC) auxiliary voltage during said cranking and starting of said engine, wherein said AC auxiliary voltage is suitable for powering said motor/generator during said cranking and starting of said engine; and a voltage sag prevention device (VSPD) that is electrically connected to said ESD and to said voltage inverter, said VSPD being operable for isolating a DC cranking support voltage from said DC auxiliary voltage during said cranking and starting of said engine;

wherein said at least one auxiliary system is powered exclusively by said DC cranking support voltage during said cranking and starting of said engine, and by said DC auxiliary voltage after said engine is running, thereby preventing a sag in a level of voltage supplied to said at least one auxiliary vehicle system during said cranking and starting of said engine.

2. The vehicle of claim 1, wherein said VSPD includes a voltage transformer, a voltage rectifier/regulator, and a voltage isolation device.

3. The vehicle of claim 2, wherein said VSPD includes a selectively actuatable mechanical relay device in electrical communication with said controller, said relay device being configured for opening during said cranking and starting of said engine to thereby provide said isolating of said DC cranking support voltage from said DC auxiliary voltage.

4. The vehicle of claim 2, wherein said VSPD includes a first and a second field effects transistor (FET) in electrical communication with said controller, wherein said first FET is inactive and said second FET is active during said cranking and starting of said engine to thereby provide said isolating of said DC cranking support voltage from said DC auxiliary voltage.

5. The vehicle of claim 1, wherein said at least one auxiliary vehicle system is a 12-volt auxiliary system selected from the group of: headlights, windshield wipers, interior lights, and radio.

6. An apparatus for preventing voltage sag in an auxiliary vehicle system aboard a mild hybrid vehicle, the vehicle having an engine, an electric motor/generator, and a 12-volt auxiliary battery operable for powering the electric motor/generator during a cranking and starting of the engine, the apparatus comprising:

a voltage inverter operable for converting a direct current (DC) auxiliary voltage from the 12-volt auxiliary battery into an alternating current (AC) auxiliary voltage sufficient for powering the electric motor/generator; and a voltage sag prevention device (VSPD) operable for converting a DC cranking support voltage from said AC auxiliary voltage, and for isolating said DC cranking support voltage from said DC auxiliary voltage during the cranking and starting of the engine;

wherein only said DC cranking support voltage powers the auxiliary vehicle system during a transient duration required for completing the cranking and starting of the engine, and wherein said DC auxiliary voltage powers the auxiliary vehicle system when the engine is running.

7. The apparatus of claim 6, wherein said VSPD includes an AC-to-AC voltage transformer, an AC-to-DC voltage rectifier/regulator, and a voltage isolation device.

8. The apparatus of claim 7, wherein said voltage isolation device includes a selectively actuatable mechanical relay device in electrical communication with said controller, said mechanical relay device being configured for opening during said cranking and starting of the engine to thereby provide said isolating of said DC cranking support voltage from said DC auxiliary voltage.

9. The apparatus of claim 7, wherein said voltage isolation device includes a first and a second field effects transistor (FET), wherein said first FET is inactive and said second FET is active during the cranking and starting of the engine to thereby isolate said DC cranking support voltage from said DC auxiliary voltage.

10. A method for preventing voltage sag in an auxiliary vehicle system of a vehicle having a battery operable for providing a direct current (DC) auxiliary voltage, an engine configured to shut off when the vehicle is idle, and an electric motor operable for cranking and starting the engine using the DC auxiliary voltage, the method comprising:

detecting a commanded cranking and starting of the engine while the engine is not running;

measuring the DC auxiliary voltage when said commanded cranking and starting of the engine is detected and prior to cranking and starting of the engine;

comparing the DC auxiliary voltage to a stored threshold voltage;

isolating a predetermined amount of DC cranking support voltage from the DC auxiliary voltage when the DC auxiliary voltage that is measured is less than said stored threshold voltage, said predetermined amount of DC cranking support voltage being sufficient for exclusively powering the auxiliary vehicle system during the duration of said cranking and starting of the engine;

powering the electric motor using only the DC auxiliary voltage and the auxiliary vehicle system using only said predetermined amount of DC cranking support voltage during said duration of said cranking and starting of the engine; and powering the auxiliary vehicle system using only the DC auxiliary voltage when the engine is running.

11. The method of claim 10, wherein said isolating a DC cranking support voltage from the DC auxiliary voltage includes opening a mechanical relay device when the DC auxiliary voltage is less than said stored threshold voltage.

12. The method of claim 10, wherein said isolating a DC cranking support voltage from the DC auxiliary voltage includes selectively activating a field effect transistor when the DC auxiliary voltage is less than said stored threshold voltage.

* * * * *